US007566190B2

(12) United States Patent
Heindl

(10) Patent No.: US 7,566,190 B2
(45) Date of Patent: Jul. 28, 2009

(54) CONNECTING PROFILE FOR CONNECTING SHEET PILES TO CARRIER ELEMENTS AND COMBINED SHEET PILE WALL COMPRISING SUCH A CONNECTING PROFILE

(75) Inventor: Richard Heindl, München (DE)

(73) Assignee: PilePro, LLC, Rapid City, SD (US)

( * ) Notice: Subject to any disclaimer, the term of this patent is extended or adjusted under 35 U.S.C. 154(b) by 0 days.

(21) Appl. No.: 12/013,320

(22) Filed: Jan. 11, 2008

(65) Prior Publication Data

US 2008/0175674 A1 Jul. 24, 2008

Related U.S. Application Data

(63) Continuation of application No. PCT/EP2006/006827, filed on Jul. 12, 2006, now abandoned.

(30) Foreign Application Priority Data

Jul. 12, 2005 (DE) ..... 10 2005 032 443
Aug. 5, 2005 (DE) ..... 10 2005 037 027

(51) Int. Cl.
*E02D 5/08* (2006.01)

(52) U.S. Cl. ..... 405/279; 405/281

(58) Field of Classification Search ..... 405/278, 405/279, 281
See application file for complete search history.

(56) References Cited

U.S. PATENT DOCUMENTS 6,042,306 A 3/2000 Arndts et al.
6,428,244 B1 * 8/2002 Wall ..... 405/279

FOREIGN PATENT DOCUMENTS

| | | | |
|---|---|---|---|
| DE | 443556 | | 5/1927 |
| DE | 511301 | | 10/1930 |
| DE | 29718052 | U1 | 12/1997 |
| DE | 19711242 | A1 | 10/1998 |
| DE | 19822997 | A1 | 12/1999 |
| DE | 19851877 | A1 | 5/2000 |
| DE | 10160125 | A1 | 7/2003 |
| DE | 10318769 | A1 | 9/2004 |
| GB | 1174430 | A | 12/1969 |
| WO | 0235010 | A | 5/2002 |

* cited by examiner

*Primary Examiner*—John Kreck
(74) *Attorney, Agent, or Firm*—Novak Druce + Quigg, LLP

(57) ABSTRACT

A connecting profile of constant cross section that couples sheet piles to carrier elements. The connecting profile exhibits a center strip, on which a coupling profile, which is to be connected to the carrier element, and an interlock profile for hooking an interlock of the sheet pile are formed. The interlock profile exhibits a supporting strip projecting from the center strip and a hook strip projecting from the center strip. The supporting strip projects at least approximately at a right angle from the center strip. The hook strip exhibits a transition section projecting at least approximately at a right angle from the center strip, and a hook section, which runs at least approximately at a right angle to the transition section in the direction of the supporting strip and which defines with the supporting strip a jaw for inserting the interlock of the sheet pile.

18 Claims, 6 Drawing Sheets

CONNECTING PROFILE FOR CONNECTING SHEET PILES TO CARRIER ELEMENTS AND COMBINED SHEET PILE WALL COMPRISING SUCH A CONNECTING PROFILE

CROSS-REFERENCE

This application is a continuation patent application of International Application No. PCT/EP2006/006827 filed 12 Jul. 2006, now abandoned. Said application is expressly incorporated herein by reference in its entirety.

FIELD

The invention relates to a connecting profile for connecting sheet piles to carrier elements. Furthermore, the invention relates to a combined sheet pile wall comprising such a connecting profile.

BACKGROUND

A connecting profile is used, in particular, to build a so-called combined sheet pile wall, where at least one sheet pile is inserted between two carrier elements—for example, double T-shaped carriers, T-shaped carriers, piles and the like. The sheet pile is joined to the carrier elements with the aid of the above-described connecting profiles. Therefore, one of the above-described connecting profiles is arranged between a carrier element and at least one sheet pile.

In order to connect the connecting profile to the carrier element, the connecting profile is provided with a coupling profile. The coupling profile is designed for connecting or coupling the connecting profile to the carrier element by hooking together, sliding on or welding the connecting profile to the carrier element. The sheet pile is joined to the connecting profile by means of an interlock profile, which is formed on the connecting profile and into which the sheet pile interlock can be hooked.

The interlock profile is usually adapted to the specific shape of the sheet pile interlock, thus rendering it expensive to produce.

In one example, DE 103 18 769 A1 discloses a connecting profile, comprising a coupling profile that is to be connected by sliding on a double T-shaped carrier, whereas a HOESCH knob of a sheet pile is hooked into the interlock profile.

In another example, DE 101 60 125 A1 discloses a connecting profile in which the coupling profile is designed so as to be welded to a pile or a carrier. The interlock profile serves to hook the interlock of a flat profile.

In view of this background, an object of the present disclosure is to provide a connecting profile, where the interlock profile guarantees that the sheet pile interlock will hold just as securely as with known interlock profile designs. However, compared to these known connecting profiles, these inventive connecting profiles will be easier to produce.

SUMMARY OF THE INVENTION

One object of the present invention is achieved with a connecting profile having a constant cross section. The connecting profiles are intended for coupling sheet piles to carrier elements, in particular for building a combined sheet pile wall. The connecting profile includes a center strip, which is to be connected to the carrier element, and an interlock profile for hooking an interlock of the sheet pile are formed. The interlock profile exhibiting a straight supporting strip, which projects from the center strip, and a hook strip, which projects from the center. The straight supporting strip of the interlock profile projects at least approximately at a right angle from the center strip. The hook strip exhibits a straight transition section, which projects at least approximately at a right angle from the center strip, and a straight hook section, which runs at least approximately at a right angle to the transition section in the direction of the supporting strip and which defines with the supporting strip a jaw for inserting the interlock of the sheet pile Furthermore, this object is achieved by a combined sheet pile wall, which is constructed of carrier elements, in particular double T-shaped carriers, and respectively at least one sheet pile. The at least one sheet pile is inserted between two carrier elements. For the purpose of connecting together the carrier elements and the sheet pile, a connecting profile which is disposed. The connecting profile comprises an interlock profile that engages with an interlock and a receiving profile that is coupled to a fastening section of one of the carrier elements. The interlock is formed on the sheet pile. The connecting profile includes a supporting strip of the interlock profile that projects at least approximately at a right angle from the center strip. Furthermore, the connecting profile includes a hook strip exhibiting a transition section, which projects at least approximately at a right angle from a center strip and exhibiting a hook section, which runs at least approximately at a right angle to the transition section in the direction of the supporting strip and which defines with the supporting strip a jaw for inserting the interlock of the sheet pile.

In the case of the connecting profile according to the invention, the interaction of the supporting strip with the right-angled hook strip of the interlock profile allows the hooked sheet pile interlock to be held securely in the inner chamber of the interlock. Furthermore, the right-angled shape of the interlock profile of the connecting profile according to the invention can facilitate different shapes of sheet pile interlocks—for example, a LARSSEN interlock, a HOESCH claw or a HOESCH knob—to be brought easily into engagement with a hook section. In so doing, the supporting strip, which is spaced apart from the hook strip, engages with the respective sheet pile interlock with the hook strip in such a manner that at least one so-called three point contact (that is, the sheet pile interlock in the interlock profile is supported at three points as viewed in the cross section of the connecting profile) or, if desired, even a wide area support of the sheet pile interlock in the interlock profile, remains unaffected, thus actively preventing the sheet pile interlock, which is engaged with the hook strip, from detaching.

The design according to the invention of the interlock profile of the connecting profile permits the connecting profile to be produced by means of a comparatively easy production method, such as hot rolling. If the connecting profile is produced by extrusion, the mold that is to be used for the extrusion is much simpler in design than the molds used for the production of conventional connecting profiles.

Other advantages of the invention follow from the following description and the drawings.

Therefore, in a preferred embodiment of the connecting profile according to the invention, the inside of the center strip that is defined by the interlock profile is flattened off and together with the supporting strip and the hook strip forms an interlock inner chamber that is at least approximately rectangular as viewed in the cross section. The rectangular shape of the inner chamber of the interlock achieves that, on the one hand, the sheet pile interlock, which is to be coupled to the interlock profile of the connecting profile, can be swung back and forth in a defined, predetermined swivel range, whereas, on the other hand, different shapes of interlocks can be accommodated in the inner chamber of the interlock. Nevertheless, the desired three-point contact or the wide area support remains unaffected.

In order to facilitate the insertion of the sheet pile interlock into the interlock profile, the length of the supporting strip is dimensioned in one embodiment of the connecting profile in such a manner that the supporting strip terminates in a plane, which runs tangentially to the outwardly facing flat side of the hook section.

In order for the sheet pile interlock to also be supported point-by-point or over a wide area on the side opposite the hook strip, an alternative embodiment proposes that the supporting strip additionally exhibits an end section, which runs at least approximately at a right angle to the supporting strip and points in the direction of the hook strip. In this case, the end section together with the hook section of the hook strip forms the jaw of the interlock profile, by means of which the sheet pile interlock projects into the inner chamber of the interlock. Thus, that section of the sheet pile interlock that is positioned in the interlock jaw is supported at two points, thus guaranteeing a secure hold of certain sheet pile interlock shapes, like a HOESCH knob. At the same time, the length of the end section of the supporting strip is kept preferably shorter than the hook section of the hook strip.

Furthermore, a further development of this alternative embodiment proposes dimensioning the supporting strip and the end section in such a manner that the end section of the supporting strip and the hook section of the hook strip lie with their outwardly facing flat sides in a common plane in order to facilitate hooking the sheet pile interlock.

In order to hold the sheet pile interlock, on the one hand, securely in the interlock profile of the connecting profile and, on the other hand, to be able to swing the sheet pile interlock back and forth in a predefined swivel range, a preferred embodiment of the connecting profile proposes that the maximum distance between the inner surface of the supporting strip and the inner surface of the transition section of the hook strip is greater than the distance between the flat side of the center strip and the inner surface of the hook section of the hook strip. In this case the ratio between the two distances is preferably in a range of 1.8:1.0 up to and including 1.2:1.

The coupling profile, which is provided on the connecting profile, is designed in a number of different ways as a function of the carrier element that is to be used—for example, double carriers, carriers or piles for connecting (hooking, sliding on or welding on) to the same. If the connecting profile is used, for example with a carrier element having a fastening section that is approximately wedge-shaped in the cross section—for example, a lobe-shaped carrier. In a preferred embodiment of the connecting profile the coupling profile is defined by the center strip; a first straight jaw that projects from one side of the center strip at an angle of 90 degrees; and a second jaw, which is bent in the direction of the first straight jaw and which extends from the other side of the center strip; so that the wedge-shaped fastening section can be hooked in.

As a function of the later position of the connecting profile on the carrier element, the bent off second jaw of the coupling profile is formed on the center strip either directly adjacent to the supporting strip of the interlock profile or adjacent to the transition section of the hook strip.

If, in contrast, a carrier element is used where the cross section of the fastening section is approximately rectangular, the coupling profile in another alternative embodiment of the connecting profile according to the invention has, as viewed in the cross section, two jaws, which project from the center strip and which run at least approximately parallel to each other and between which the carrier element with its fastening section is to be inserted or slid on.

In a preferred embodiment of the connecting profile according to the invention, the coupling profile is offset, as viewed in the cross section of the connecting profile, on the center strip in such a manner in relation to the interlock profile that one of the two jaws is offset outwardly in relation to the transition section of the hook strip. As a result, when the carrier element with its fastening section engages with the coupling profile of the connecting profile, the carrier element projects, as viewed in the cross section, further outwardly away from the carrier element than the sheet pile section, with which the sheet pile projects the furthest outwardly. This feature is advantageous when the combined sheet pile wall is used in harbors or in docking places, because, for example, a ship that sails inadvertently against the combined sheet pile wall hits only the carrier elements, whereas the sheet piles are protected against total destruction.

According to another aspect, the invention relates to a combined sheet pile wall in which the connecting profile according to the invention is used. In this case, the connecting profile according to the invention is used, in particular, preferably for coupling sheet piles with LARSSEN interlocks, HOESCH knobs or HOESCH claws.

DETAILED DESCRIPTION

Figure 1:
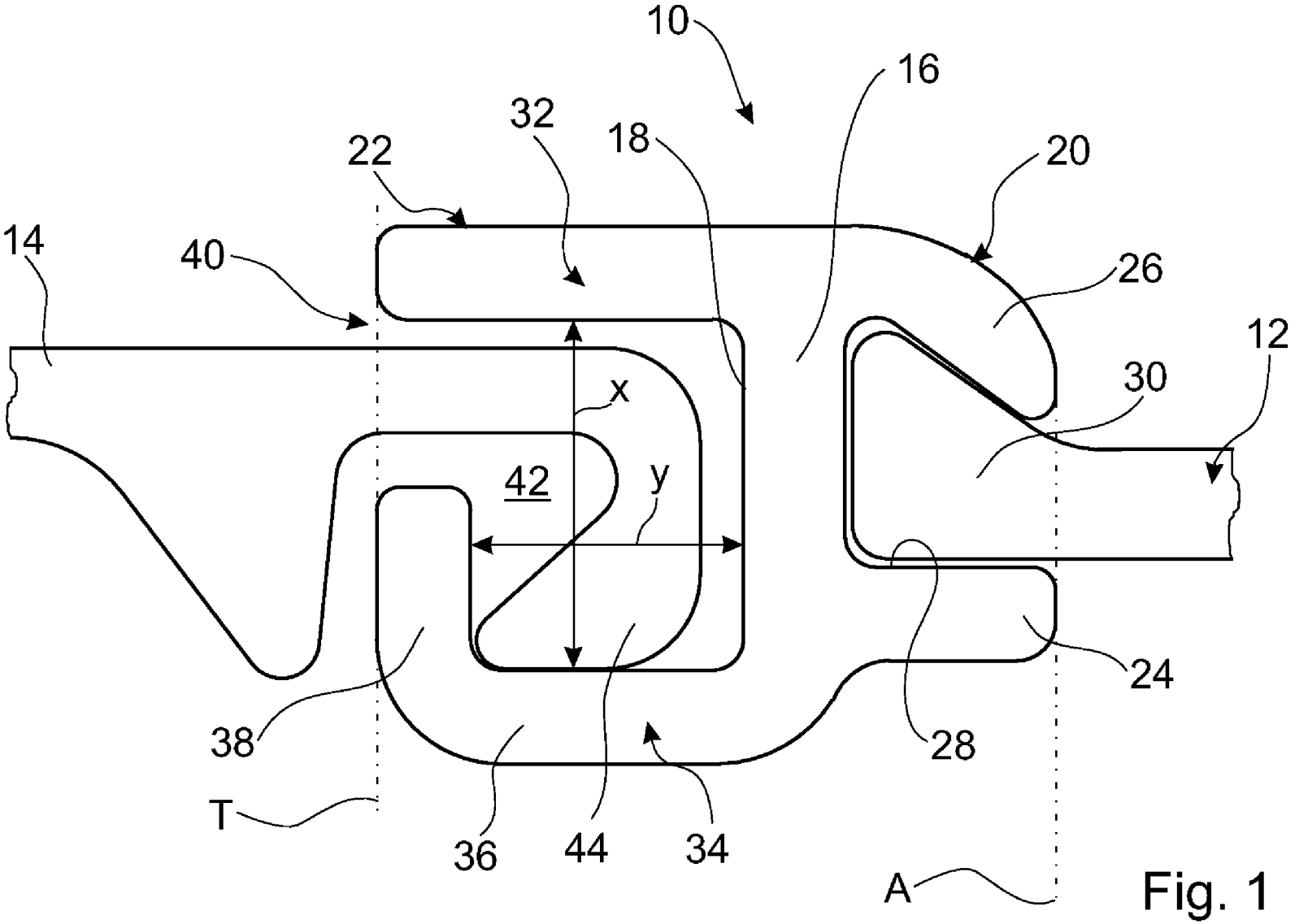
FIG. 1 is a top view of the face side of a first embodiment of a connecting profile according to the invention, which is engaged with a lobe-shaped carrier and a LARSSEN interlock of a sheet pile.

FIG. 1 depicts a first embodiment of a connecting profile 10 configured according to the invention and which is produced by hot rolling and serves to connect a carrier element 12 to a sheet pile 14. The connecting profile 10 exhibits a central center strip 16 having a straight, planar center section 18. The coupling profile 20 for connecting to the carrier element 12 is formed on the flat side which belongs to the center section 18. An interlock profile 22 for coupling an interlock of the sheet pile 14 is formed on the second flat side of the center section 18 that faces away.

The coupling profile 20 is defined by the center strip 16 off of which a first straight jaw 24 projects at a 90 degree angle in the vicinity of the longitudinal edge, which belongs to the center strip 16 and which is shown at the bottom in FIG. 1 and by a second jaw 26, which projects from the longitudinal edge (shown at the top) of the center strip 16 and is bent in the direction of the first straight jaw 24. The two jaws 24 and 26 terminate in a plane A which runs at least approximately parallel to the center strip 16 and together enclose, with the center strip 16, a receiving element 28 that is approximately trapezoidal in cross section and which is intended for hooking a fastening section 30 of the carrier element 12.

As FIG. 1 shows, the trapezoidal cross section of the receiving element 28 is adapted to the cross sectional shape of the fastening section 30 of the carrier element 12—for example a double T-shaped carrier—so that the coupling profile 20 can be slid onto the fastening section 30 of the carrier element 12 with little clearance. In the illustrated example, the fastening section 30 has a cross section which is expanded in the shape of a wedge in the direction of the free end.

The interlock profile 22 is formed by a supporting strip 32 and a hook strip 34. The supporting strip 32 extends from the longitudinal edge (shown at the top in FIG. 1) of the center strip 16 and projects at least approximately at a right angle from the flat side of the center strip 16.

The hook strip 34 has a transition section 36, which also projects at least approximately at a right angle from the flat side of the center strip 16. One end of the transition section is flush with the longitudinal edge (shown at the bottom in FIG. 1) of the center strip 16. The other end of the transition section 36 is bent over and passes over into a hook section 38, which runs at least approximately at a right angle to the transition section 36 and, thus, runs at least approximately parallel to the flat side of the center strip 16. The end of the hook section 38 points in the direction of the supporting strip 32. The supporting strip 32 and the hook section 38 together define a jaw 40. In this case the length of the supporting strip 32 is dimensioned in such a manner that the supporting strip 32 terminates in a plane T which conforms tangentially with the outside of the hook section 38 and runs parallel to the flat side of the center strip 16.

The flat side of the center strip 16, the interlock profile 22, the supporting strip 32, and the hook strip 34 together define an interlock inner chamber 42, which has at least an approximately rectangular cross section and which is partially open in the direction of the side, facing away from the connecting profile 20, owing to the jaw 40. Hence, the maximum distance x between the inner surface of the supporting strip 32 and the transition section 36 of the hook strip 34 is greater than the maximum distance y between the flat side of the center strip 16 and the inner surface of the hook section 38. The ratio between the two distances x and y is approximately 1.3:1.0 in the embodiment depicted in FIG. 1.

In the assembled state, the connecting profile 10 is slid with its coupling profile 20 onto the fastening section 30, which belongs to the double T-shaped carrier 12 and is expanded in the shape of a wedge.

As stated in the introductory part, the shape of the interlock profile 22 makes it possible to hook into a variety of different shapes of sheet pile interlocks. Therefore, a so-called LARSSEN interlock 44 of an AZ sheet pile 14 is hooked, as the sheet pile interlock, into the interlock profile 22. However, in the application case shown in FIG. 2, the interlock profile 22 of the connecting profile 10 engages with a so-called HOESCH claw 46 of a HOESCH sheet pile 14.

Figure 2:
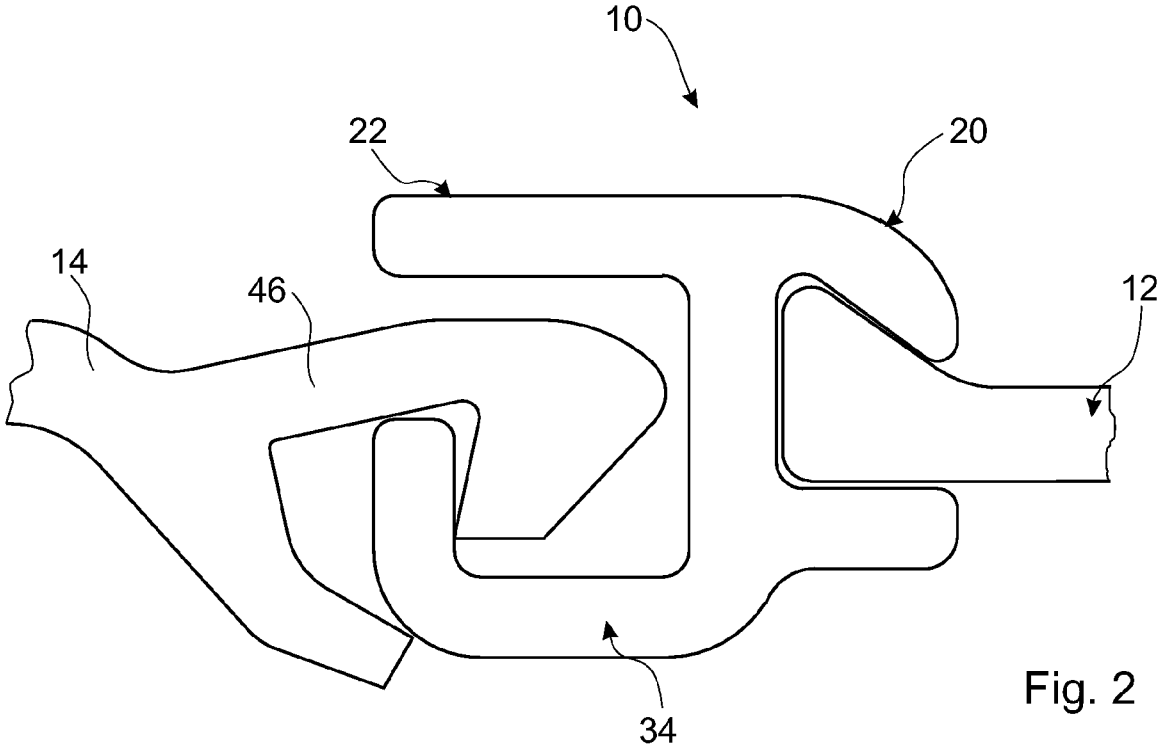
FIG. 2 is a top view of the connecting profile, which is shown in FIG. 1 and which is engaged with a HOESCH claw of a sheet pile.

As depicted in FIGS. 1 and 2, the interlock inner chamber 42 having a rectangular cross section achieves that both the LARSSEN interlock 44 and the HOESCH claw 46 are easily accommodated in the inner chamber 42 of the interlock. The comparatively wide jaw 40 of the interlock, on the one hand, and the rectangular cross sectional shape of the inner chamber 42 of the interlock, on the other hand, make it possible for both the LARSSEN interlock 44 and the HOESCH claw 46 to swing back and forth in the interlock profile 22. At the same time the LARSSEN interlock 44 or the HOESCH claw 46 is accommodated in the inner chamber 42 of the interlock in such a manner that the interlock 44 or 46 is always supported, as viewed in the cross section of the connecting profile 10, on two planes or on three points in the inner chamber 42 of the interlock. Therefore, when the system comprising connecting profile 10, carrier element 12 and sheet pile 14 is rammed in, the interlock 44 or 46 is actively prevented from jumping out of the interlock profile 22.

As a transitional measure, the coupling profile 20 having a trapezoidal cross section is depicted. Of course, it is possible to provide other coupling profiles 20, which are to be adapted in the cross section according to the respective carrier element 12. Thus, coupling profiles, which are designed for welding on may be used, if the carrier element is, for example, a pile.

Figure 3:
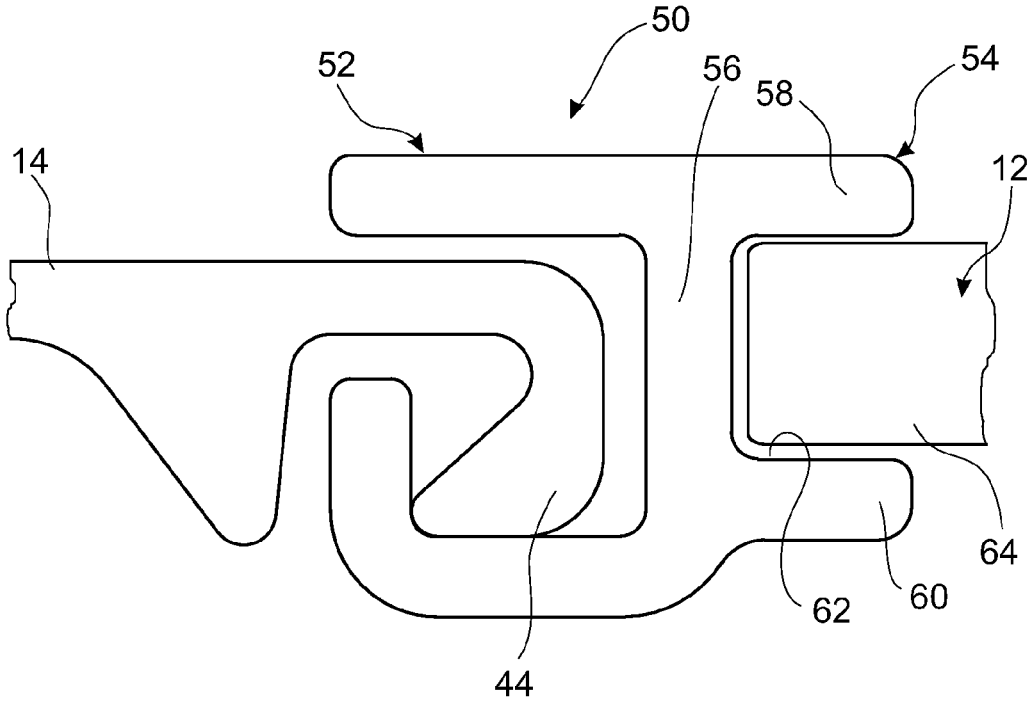
FIG. 3 is a top view of a variant of the first embodiment of the connecting profile, which is shown in FIG. 1 and is designed for connecting to a conventional double T-shaped carrier with a fastening section having a rectangular cross section.

Hence, FIG. 3 depicts a variant of the connecting profile 10, shown in FIGS. 1 and 2. In this modified connecting profile 50, the interlock profile 52 matches the interlock profile 22. However, the coupling profile 54 of the connecting profile 50 exhibits two jaws 58 and 60, which project from the center strip 56 and which project approximately at a right angle from the center strip 56 and are constructed so as to be mirror images to each other. The result is a jaw 62, which has an approximately rectangular cross section and which is intended for sliding on a fastening section 64, which has an approximately rectangular cross section and belongs to a carrier element 12, like a conventional double T-shaped carrier.

Figure 4:
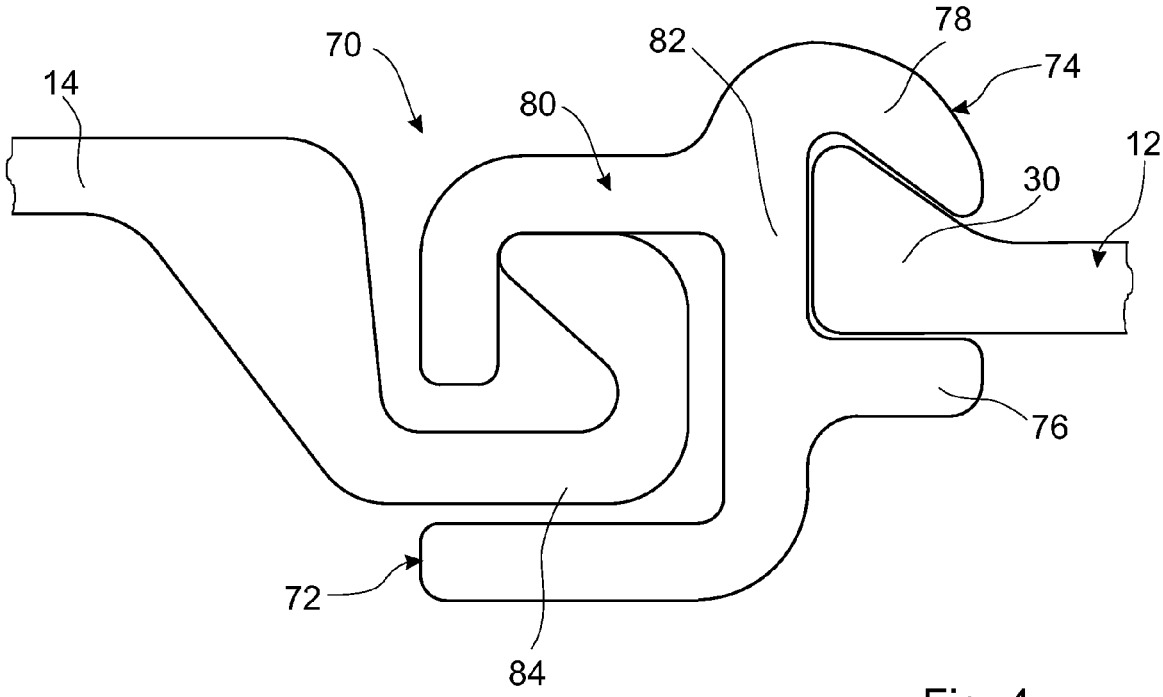
FIG. 4 is a top view of a second embodiment of the connecting profile according to the invention, where the coupling profile for the lobe-shaped carrier is the mirror inverse of the embodiment shown in FIG. 1, and is offset on the center strip.

FIG. 4 depicts a second embodiment of a connecting profile 70 according to the invention. In the case of this connecting profile 70 the construction of the interlock profile 72 matches that of the interlock 22. The inside cross section of the coupling profile 74 also matches the inside cross section of the coupling profile 20. However, the two jaws 76 and 78 are configured so as to be the mirror inverse of the jaws 24 and 26 of the coupling profile 20, shown in FIG. 1.

Thus, the angled off jaw 78 adjacent to the hook strip 80 of the interlock profile 72 is formed on the center strip 82. In this case the center strip 82 extends beyond the hook strip 80 and passes over its longitudinal edge into the angled off jaw 78. In contrast, the straight jaw 76 projects outwardly from the flat side of the center strip 82, so that the coupling profile 74, which is offset outwardly in total by approximately one wall thickness of the hook strip 80, is formed on the center strip 82.

As a result, the connecting profile 70 can be fastened to the carrier element 12 with the hook strip 80 facing inwardly so that an offset LARSSEN interlock 84 of the sheet pile 14 can be hooked into the interlock profile 72.

The offset design of the coupling profile 74 allows that after the connecting profile 70 is fitted together on the carrier element 12, the connecting profile holds the sheet pile 14 in such a manner that the carrier element 12 protrudes with its fastening section 30 further outwardly than the sheet pile 14 with its sheet pile section. In this way it is guaranteed that in the event of a collision by an object—for example, a ship—with the system comprising the carrier element 12, sheet pile 14 and connecting profile 70, the carrier element 12 is the first to absorb the collision forces.

Figure 5:
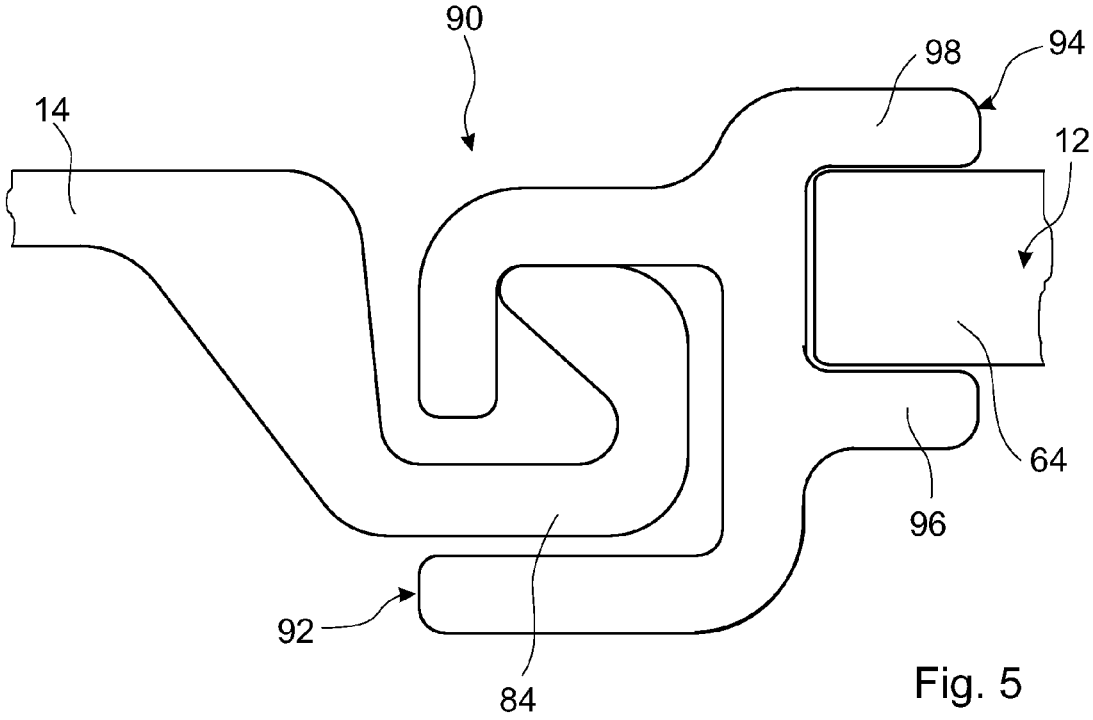
FIG. 5 is a top view of a variant of the second embodiment, which is designed for fastening to a conventional double T-shaped carrier exhibiting a fastening section having a rectangular cross section.

FIG. 5 depicts a variant of the connecting profile 70, shown in FIG. 4. This modified connecting profile 90 exhibits an identically constructed interlock profile 92 and differs with respect to the connecting profile 70 only in the construction of the coupling profile 94. In the present case, as in the case of the variant shown in FIG. 3, the coupling profile 94 consists of two jaws 96 and 98, which run parallel to each other and serve to accommodate the fastening section 64 of a conventional double T-shaped carrier, which serves, for example, as the carrier element 12.

Figure 6:
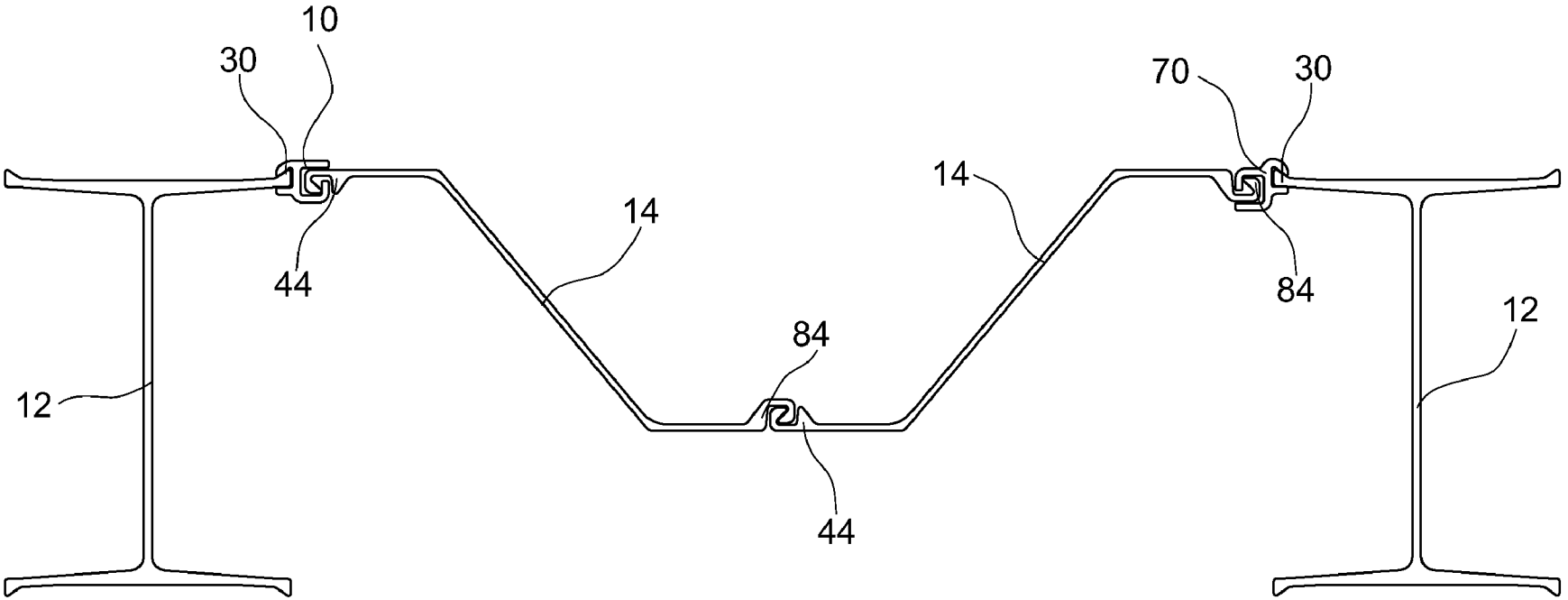
FIG. 6 is a top view of a section of a combined sheet pile wall, which is built of two lobe-shaped carriers and two LARSSEN sheet piles, both of which are connected together by means of connecting profiles, as shown in FIGS. 1 and 4.

FIG. 6 is a section of a combined sheet pile wall, which is built of two double T-shaped carriers 12 and two AZ sheet piles 14 with LARSSEN interlocks 44 and 84. The two immediately adjacent LARSSEN interlocks 44 and 84 of the AZ sheet piles 14 are hooked together.

In order to fasten the sheet pile 14 (shown on the left in FIG. 6), the illustrated embodiment uses the connecting profile 10 (compare to FIG. 1), which is hooked into the fastening section 30 of the double T-shaped carrier 12 and engages with the LARSSEN interlock 44 of the AZ sheet pile 14 (shown on the left).

In contrast, the AZ sheet pile 14, which is shown on the right in FIG. 6, engages with the connecting profile 70, which is shown in FIG. 4 and which is hooked into the double T-shaped carrier 12, which is shown on the right.

Figure 7:
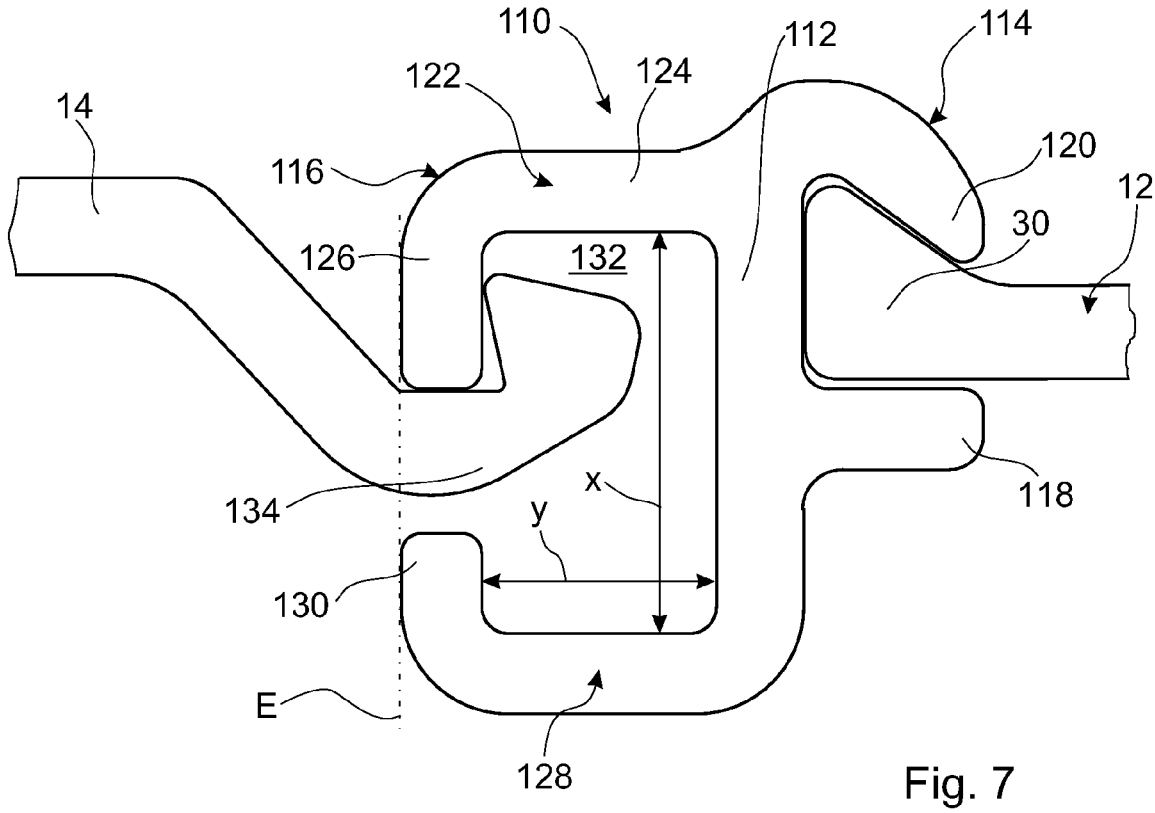
FIG. 7 is a top view of the face side of a third embodiment of the connecting profile according to the invention, where the supporting strip is also bent in the shape of a hook and which is engaged with a lobe-shaped carrier and a HOESCH knob of a sheet pile.

FIG. 7 depicts a third embodiment of a connecting profile 110 according to the invention. The connecting profile 110 also exhibits a center strip 112. One flat side of the center strip has a coupling profile 114 for connecting to the carrier element 12; and the other flat side of the center strip has an interlock profile 116 for hooking an interlock of the sheet piles 14.

As in the case of the second embodiment shown in FIG. 4, the coupling profile 114 has a straight jaw 118, which projects at a right angle from the center strip 112, and a second jaw 120, which projects in a bent off manner from the center strip 112, so that an inner chamber, which has a trapezoidal shape as viewed in the cross section and which is intended for accommodating the fastening section 30, which has a wedge-shaped cross section and belongs to the carrier element 12, is formed. In this case, the center strip 112 is drawn upwardly and passes over into the bent off jaw 120.

With respect to the transition of the center strip 112 into the jaw 120, the interlock profile 116 for hooking the sheet pile 14 in FIG. 7 is formed on the other flat side of the center strip 112 in such a manner that it is offset slightly downwards.

The hook strip 122 of the interlock profile 116 matches the hook strip 80 of the interlock profile 72 of the connecting profile 70. Therefore, the hook strip 122 also has a transition section 124, which projects at least approximately at a right angle from the flat side of the center strip 112. The transition section 124 in turn passes over into a hook section 126, which runs at least approximately at a right angle to the transition section 124 and which points in the direction of the supporting strip 128 of the interlock profile 116.

Starting from the longitudinal edge (shown at the bottom in FIG. 7) of the center strip 112, the supporting strip 128 runs at least approximately at a right angle to the flat side of the center strip 112. Therefore, the supporting strip 128 in turn passes over into an end section 130, which runs at least approximately at a right angle to the supporting strip 128 and, thus, runs at least approximately parallel to the flat side of the center strip 112.

The end section 130 of the supporting strip 128 and the hook section 126 are in alignment with each other, have approximately the same wall thickness, and lie with their outwardly facing flat sides in a common plane E, which runs at least approximately parallel to the flat side of the center strip 112. As a result, the interlock profile 116 also has an interlock inner chamber 132, which has at least an approximately rectangular cross section, in this third embodiment. However, the center strip 112 is designed so as to be longer, as viewed in the cross section, in comparison to the center strip 16 of the first embodiment, so that the ratio between the distance x and the distance y is approximately 1.6 to 1.

As in the case of the second embodiment shown in FIG. 4, this third embodiment also has an interlock profile 116, which is offset slightly downwards in relation to the coupling profile 114. Therefore, in the case of the connecting profile 110 fastened to the carrier element 12, the interlock profile 116 is also offset downwards in relation to the fastening section 30 of the carrier element 12; and the sheet pile 14, which is to be hooked, projects less outwardly away from the carrier element 12 than the fastening section 30 of the carrier element 12.

The connecting profile 110 that is constructed in this way is used, in particular, to hook a sheet pile 14, which exhibits as the sheet pile interlock a so-called HOESCH knob 134, as depicted in FIG. 6. In this case, too, the sheet pile interlock—in the present case the HOESCH knob 134—can be swung in a predefined swivel range of approximately 0 to 15 deg. and is supported at three points or over a wide area inside the inner chamber 132 of the interlock.

Figure 8:
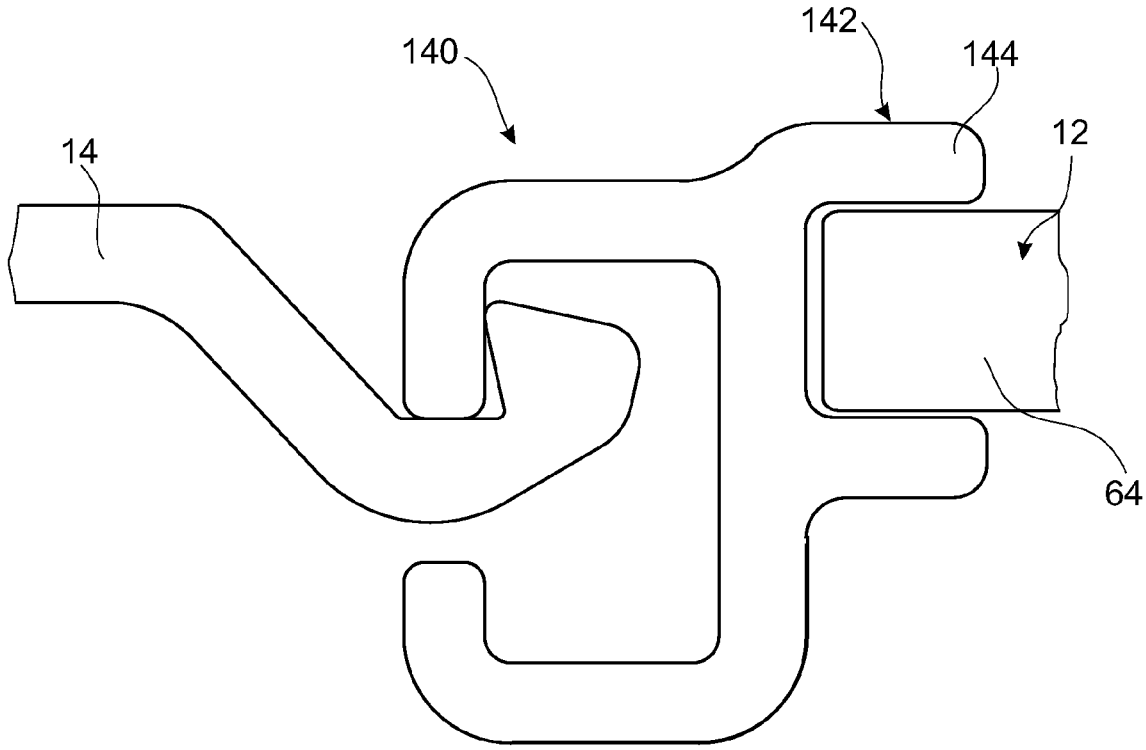
FIG. 8 is a top view of a variant of the third embodiment of the connecting profile according to the invention, which is depicted in FIG. 7 and which is designed to fasten to a conventional double T-shaped carrier, exhibiting a fastening section having a rectangular cross section.

FIG. 8 depicts a variant of the connecting profile 110 that is shown in FIG. 7. This connecting profile 140 differs from the connecting profile 110 only in the construction of the coupling profile 142. In the case of this coupling profile 142, the jaw 144, which is shown at the top in FIG. 7, runs straight, so that the coupling profile 142 is suitable for inserting a fastening section 64, which has a rectangular cross section and belongs to the carrier element 12.

Figure 9:
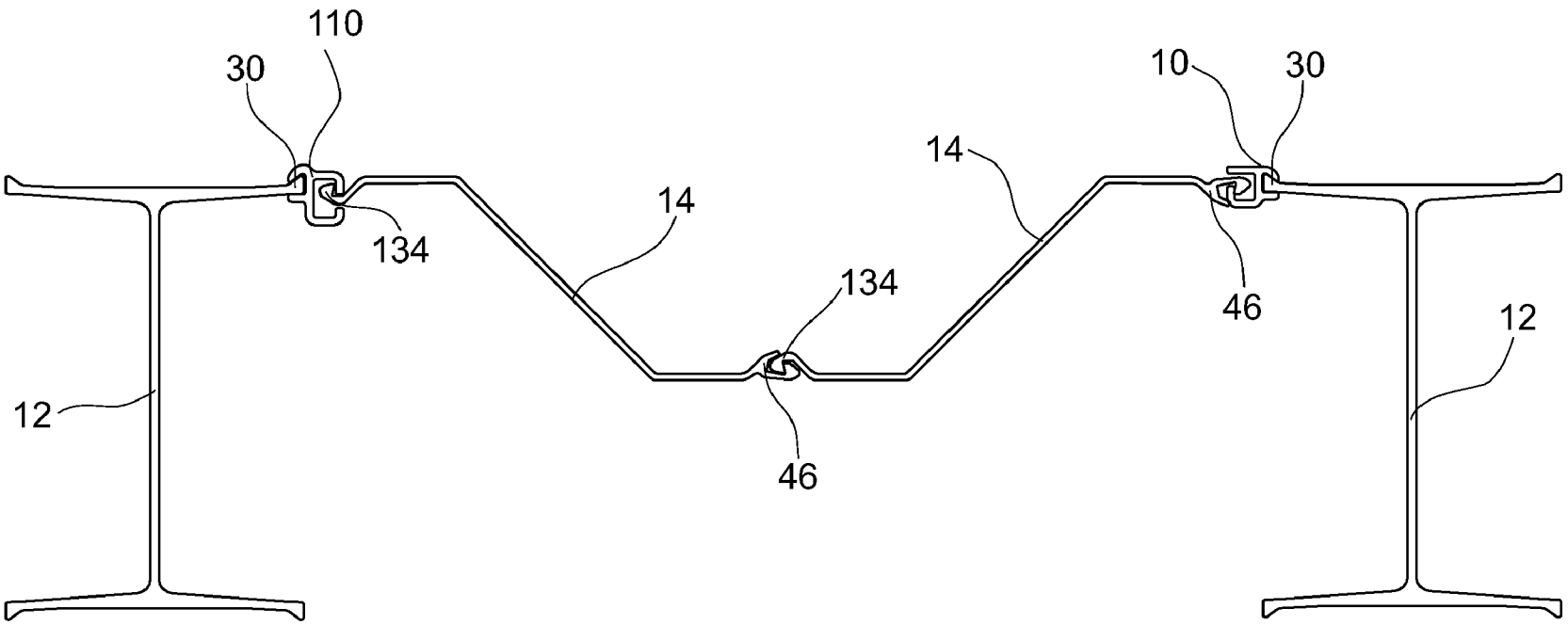
FIG. 9 is a top view of a detail of a combined sheet pile wall with two carrier elements and two Z-shaped sheet piles, which are inserted between the carrier elements, with HOE- SCH interlocks, the two being used in the connecting profiles, which are shown in FIGS. 1 and 7.

FIG. 9 is another section of a combined sheet pile wall, which is built of two double T-shaped carriers 12 and two Z-shaped sheet piles 14 with HOESCH interlocks 46 and 134. The two immediately adjacent HOESCH interlocks 46 and 134 of the Z-shaped sheet piles 14 are hooked together.

In order to fasten the sheet pile 14 (shown on the left in FIG. 9), the illustrated embodiment uses the connecting profile 110 (compare to FIG. 7), which is hooked into the fastening section 30 of the double T-shaped carrier 12 and engages with the HOESCH knob 134 of the Z-shaped sheet pile 14 (shown on the left).

In contrast, the Z-shaped sheet pile 14, which is shown on the right in FIG. 9, engages with the connecting profile 10, which is shown in FIG. 1 and which is hooked into the double T-shaped carrier 12, which is shown on the right.

The essentially rectangular shape of the interlock profiles 22, 52, 72, 92 and 116 makes is possible to connect a variety of customary interlocks, like HOESCH claws, HOESCH knobs, LARSSEN interlocks and the like, to the connecting profiles 10, 50, 70, 90, 110 and 140 according to the invention. At the same time the sheet pile interlocks are held securely in the interlock profile 22, 52, 72, 92 or 116 since they are supported over a wide area or with the described three-point contact. At the same time the shape according to the invention of the interlock profiles 22, 52, 72, 92 and 116 also makes it possible to produce the connecting profiles 10, 50, 70, 90, 110 and 140 by rolling, in particular by hot rolling. As a result, the production is simplified as compared to the conventional extruded connecting profiles.

Furthermore, the use of the connecting profiles 10, 50, 70, 90, 110 and/or 140 according to the invention makes it possible to implement extreme swivel angles between the sheet piles 14 and the carrier elements 12. As a result, it is possible to build combined sheet pile walls having a closed or curved contour or a sharp corner. Even if the distances may vary or the carrier elements 12 may twist with respect to each other, when the individual carrier elements 12 are rammed down between the adjacent carrier elements 12, such offsets can be compensated with the use of the connecting profiles 10, 50, 70, 90, 110 and/or 140 according to the invention.

It is clear that, instead of the Z-shaped sheet piles 14 shown in FIGS. 6 and 9, U-shaped sheet piles, which are provided with HOESCH interlocks, LARSSEN interlocks or comparably shaped interlocks, can be used to build a combined sheet pile wall.

What is claimed is:

1. A connecting profile, which has a constant cross section and is intended for coupling sheet piles to carrier elements, in particular for building a combined sheet pile wall comprising:

sheet piles and carrier elements, like double T-shaped carriers;

the connecting profile exhibiting a center strip, a coupling profile, which is to be connected to the carrier element and which is formed on the first side of the center strip, and an interlock profile for hooking an interlock of the sheet pile, the interlock profile being formed on a second side of the center strip that faces way from the first side of the center strip;

the interlock profile exhibiting a straight supporting strip, which projects from the center strip, and a hook strip, which projects from the center strip;

wherein the straight supporting strip of the interlock profile projects at least approximately at a right angle from the second side of the center strip; and wherein the hook strip exhibits a straight transition section, which projects at least approximately at a right angle from the second side of the center strip and which bends over into a straight hook section which runs at least approximately at a right angle to the transition section in the direction of the supporting strip and the end of which defines, with the end of the supporting strip, a jaw for inserting the interlock of the sheet pile, the jaw being arranged opposite to the second side of the center strip.

2. The connecting profile as recited in claim 1, further comprising an inside, which belongs to the center strip and is defined by the interlock profile, and wherein the inside is flattened off and forms jointly with the supporting strip and the hook strip an interlock inner chamber, which is at least approximately rectangular as viewed in the cross section.

3. The connecting profile as recited in claim 1, wherein the supporting strip terminates in a plane, which runs tangentially to an outwardly facing flat side of the hook section.

4. The connecting profile as recited in claim 1, wherein the supporting strip exhibits an end section, which runs at least approximately at a right angle to the supporting strip and points in the direction of the hook strip.

5. The connecting profile as recited in claim 4, characterized in that the end section of the supporting strip and the hook section of the hook strip lie with their outwardly facing flat sides in a common plane.

6. The connecting profile as recited in claim 1, wherein a maximum distance between an inner surface of the supporting strip and an inner surface of the transition section of the hook strip is greater than a second distance between a flat side of the center strip and an inner surface of the hook section of the hook strip.

7. The connecting profile as recited in claim 6, wherein the ratio between the maximum and second distances is in a range of 1.8 to 1 up to and including 1.2 to 1.

8. The connecting profile as recited in claim 1, wherein the interlock profile is dimensioned so as to accommodate an interlock of a LARSSEN sheet pile or a HOESCH sheet pile, which is to be connected.

9. The connecting profile as recited in claim 1, wherein the coupling profile is defined by the center strip; a first straight jaw, which projects from the first side of the center strip and faces away from the interlock profile at an angle of 90 degrees and a second jaw, which is bent off in the direction of the first straight jaw and which extends from the first side of the center strip and which is spaced apart from the first jaw.

10. The connecting profile as recited in claim 9, wherein the bent off second jaw of the coupling profile and the supporting strip of the interlock profile are formed directly adjacent to each other on the center strip, and wherein the bent off second jaw and the supporting strip each have an outer flat side, the outer flat side of the second jaw and the outer flat side of the supporting strip passing over into each other.

11. The connecting profile as recited in claim 9, wherein the bent off second jaw of the coupling profile and the transition section of the hook strip are formed directly adjacent to each other on the center strip.

12. The connecting profile as recited in claim 1, wherein the coupling profile exhibits two jaws, which run at least approximately parallel to each other and project from the first side of the center strip and between which the carrier element is to be inserted with a fastening section for fastening.

13. Connecting profile, as claimed in claim 9, wherein the coupling profile is offset, as viewed in the cross section of the connecting profile, on the center strip in such a manner in relation to the interlock profile that one of the two jaws is offset outwardly in relation to the transition section of the hook strip.

14. The connecting profile as recited in claim 1, wherein the coupling profile is designed for welding to the carrier element.

15. The connecting profile as recited in claim 1, wherein the connecting profile is produced by rolling.

16. A combined sheet pile wall comprising:

a plurality of carrier elements, in particular double T-shaped carriers;

at least one sheet pile, which is inserted between two of the carrier elements;

a connecting profile which is disposed between said carrier elements and said sheet pile, wherein the connecting profile connects together the carrier elements and the sheet pile;

an interlock profile, which engages with an interlock, that is formed on the sheet pile;

a receiving profile, that is coupled to a fastening section of one of the carrier elements are formed;

the connecting profile having a center strip, wherein on a first side of the center strip, the receiving profile is formed and wherein on a second side of the center strip that faces away from the first side the interlock profile is formed;

wherein the interlock profile exhibiting a supporting strip, which projects from the center strip, and a hook strip, which projects from the center strip;

wherein the straight supporting strip of the interlock profile projects at least approximately at a right angle from the second side of the center strip; and wherein the hook strip exhibits a straight transition section, which projects at least approximately at a right angle from the second side of the center strip; and which bends over into a straight hook section which runs at least approximately at a right angle to the transition section in the direction of the supporting strip and the end of which defines with the end of the supporting strip a jaw for inserting the interlock of the sheet pile, the jaw being arranged opposite to the second side of the center strip.

17. The combined sheet pile wall as recited in claim 16, wherein the interlock, which belongs to the sheet pile and which engages with the connecting profile, is a LARSSEN interlock.

18. The combined sheet pile wall as recited in claim 16, wherein the interlock, which belongs to the sheet pile and which engages with the connecting profile, is a HOESCH claw or a HOESCH knob.

* * * * *